US007969264B2

(12) United States Patent
Smalen et al.

(10) Patent No.: US 7,969,264 B2
(45) Date of Patent: Jun. 28, 2011

(54) CHOKE DEVICE FOR FREQUENCY CONVERTER

(75) Inventors: Matti Smalen, Klaukkala (FI); Henri Mikael Kinnunen, Veikkola (FI)

(73) Assignee: ABB OY, Helsinki (FI)

( * ) Notice: Subject to any disclaimer, the term of this patent is extended or adjusted under 35 U.S.C. 154(b) by 201 days.

(21) Appl. No.: 12/508,004

(22) Filed: Jul. 23, 2009

(65) Prior Publication Data

US 2010/0039201 A1 Feb. 18, 2010

(30) Foreign Application Priority Data

Aug. 13, 2008 (FI) ..... 20085770

(51) Int. Cl.
*H01F 30/12* (2006.01)
*H01F 27/08* (2006.01)
*H01F 27/10* (2006.01)

(52) U.S. Cl. ..... 336/5; 336/55; 336/57; 336/60

(58) Field of Classification Search ..... 336/55, 336/57, 60, 61, 5; 363/68
See application file for complete search history.

(56) References Cited

U.S. PATENT DOCUMENTS 4,234,862 A * 11/1980 Prevotat ..... 336/5
4,338,657 A * 7/1982 Lisin et al. ..... 363/68
5,202,664 A * 4/1993 Poulsen ..... 336/5
6,792,666 B1 * 9/2004 Bolotinsky et al. ..... 29/602.1
7,839,251 B2 * 11/2010 Sodo ..... 336/180
2002/0125978 A1 * 9/2002 Aoki et al. ..... 336/5
2005/0030140 A1 * 2/2005 Dahlgren et al. ..... 336/5
2006/0044103 A1 3/2006 Roebke et al.
2008/0094159 A1 * 4/2008 Sodo ..... 336/5

FOREIGN PATENT DOCUMENTS

EP 1 564 762 8/2005
GB 1149567 4/1969
JP 56032709 A * 4/1981

* cited by examiner

*Primary Examiner* — Anh T Mai
(74) *Attorney, Agent, or Firm* — Ladas & Parry LLP

(57) ABSTRACT

A choke device for a frequency converter, comprising three windings composed of conductors wound around three substantially parallel axes (A, B, C), respectively, the windings being located triangularly with respect to each other in such a manner that, when the choke device is viewed in the longitudinal direction of said winding axes (A, B, C), the winding axes are located at the vertices of the triangle, the choke device further comprising an envelope (1) surrounding the windings, a first end (3A) thereof being provided with at least one opening (20) for receiving cooling medium to the inside of the envelope, and a second end (3B) being provided with at least one opening for discharging the cooling medium from the envelope, and an envelope axis (D) between said first and second ends being substantially parallel with the winding axes (A, B, C).

17 Claims, 2 Drawing Sheets

CHOKE DEVICE FOR FREQUENCY CONVERTER

FIELD OF THE INVENTION

The invention relates to a choke device for a frequency converter.

BACKGROUND OF THE INVENTION

A frequency converter is a device used for instance for controlling a motor or another load. The control of a motor may be implemented reliably by means of a frequency converter for instance in such a manner that the motor accurately implements the desired speed or torsional moment instruction, for example.

One or more choke devices are typically associated with frequency converters. Examples of such choke devices possibly used in frequency converters or in association therewith include an input choke and an output choke.

The input choke of a frequency converter is a filtering device connected between a feeding network and the rectifier (e.g. alternating current bridge) of the frequency converter and serving to decrease the distortion of the current taken from the network and to protect the components of the alternating current bridge of the frequency converter from interferences and voltage peaks coming from the direction of the feeding network. In addition, the input choke may be used to attenuate the electromagnetic radiation of the frequency converter. In the case of a plurality of diode bridges, each diode bridge typically has an input choke of its own.

A possible output choke in a frequency converter, in turn, is connected between the inverter of the frequency converter and the device (load) it is feeding. The output choke of the frequency converter preferably restricts the derivative of the output voltage of the converter, thus protecting the device the frequency converter is feeding. When the device fed is a motor, the output choke protects the windings of the motor against partial discharges and restricts the bearing currents caused in the motor by the common-mode voltage generated by the pulse-form three-phase output voltage of the converter. Depending on the structure of the inverter, the choke device serving as its output choke may comprise one or more individual choke windings per phase. For instance in high-current inverter assemblies, it is known to connect a plurality of switch components in parallel to achieve the current-carrying capacity required, whereby the inverter comprises a plurality of output branches per each phase, each of which may be provided with an output choke.

In prior art choke device solutions for a frequency converter, the windings of the choke device are placed in parallel in a plane like manner. The problem in such prior art solutions is that the flow of cooling medium, such as air, through the choke device is uncontrolled; the cooling medium flows faster where the resistance encountered thereby is smallest. This being so, the cooling of one or some windings of a choke device comprising for instance three parallel windings may remain insufficient or at least require a disproportionately high flow of cooling medium. Furthermore, the heat stresses experienced by the different windings are unevenly distributed.

BRIEF DESCRIPTION OF THE INVENTION

The object of the invention is thus to provide an apparatus so as to solve the above problem or at least alleviate it. The object of the invention is achieved with a choke device for a frequency converter, characterized in what is stated in independent claim 1. Preferred embodiments of the invention are described in the dependent claims.

The invention is based on the windings of the choke device being in a triangular fashion with respect to each other, i.e. diverge from a plane in such a manner that, when the choke device is viewed in the longitudinal direction of the winding axes, the winding axes constitute the vertices of the triangle, and on the choke device comprising an envelope surrounding the windings, the envelope axis between the ends of which is substantially parallel with the winding axes.

An advantage of the choke device for a frequency converter of the invention is that the location of the longitudinal winding axes with respect to each other, which diverges from a plane, and the envelope surrounding the windings enables a controlled circulation of cooling medium, such as air, through the windings. Thanks to the invention, an even cooling of the windings of the choke device is easily implementable with a simple structure.

BRIEF DESCRIPTION OF THE FIGURES

In the following, the invention will be described in more detail in connection with preferred embodiments with reference to the accompanying drawings, in which.

DETAILED DESCRIPTION OF THE INVENTION

Figure 1:
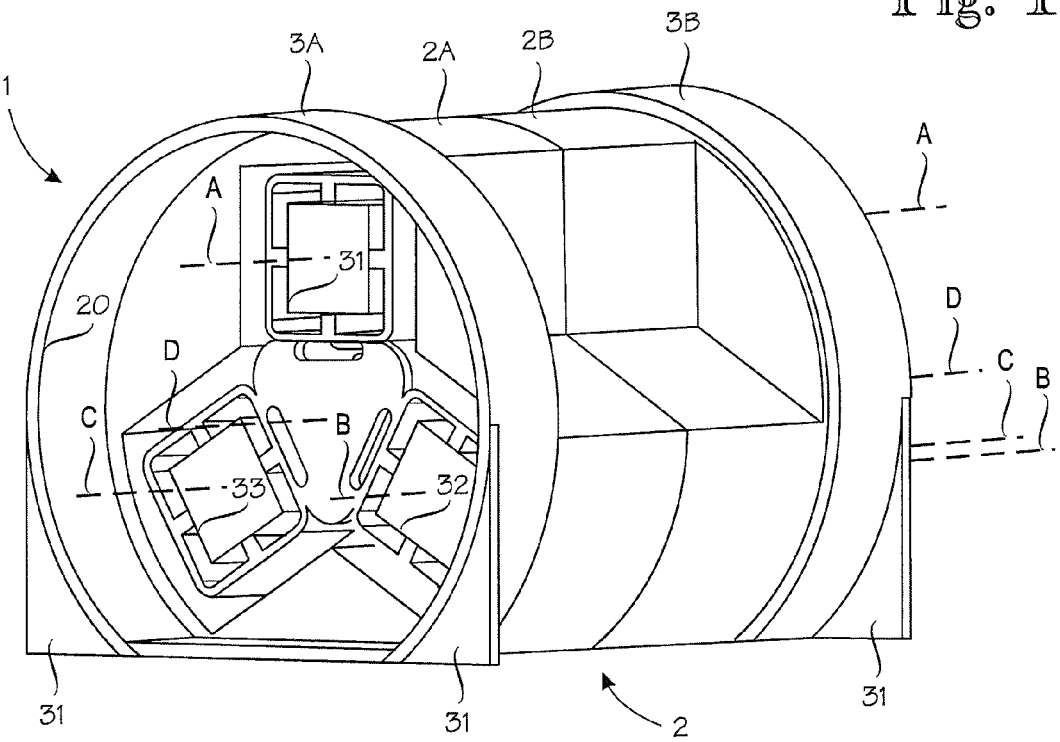
FIG. 1 shows the choke device for a frequency converter in accordance with an embodiment.

FIG. 1 shows a perspective view of the choke device of a frequency converter in accordance with an embodiment. It is to be noted that the practice of the invention is not restricted to any given type of frequency converter. The feed of the frequency converter or the type of load controlled thereby or the connections therebetween, such as voltage level or number of phases, do not either have any significance to the basic idea of the invention. This is why the structure of the frequency converter is not dealt with in any more detail in the following. In addition, the choke device may comprise a three-phase choke or three single-phase chokes, for example. Furthermore, the choke device may be the input choke of a frequency converter or the output choke of a frequency converter. However, the invention is not restricted to these examples, but may be applied also to other types of frequency converter chokes.

The choke device of a frequency converter shown in FIG. 1 comprises three windings composed of conductors wound around corresponding three substantially parallel axes A, B and C. The windings are not shown in FIG. 1. The choke device further comprises an envelope 1 surrounding the windings, its first end 3A being provided with an opening for receiving cooling medium to the inside of the envelope 1, and a second end 3B being provided with an opening for discharging the cooling medium from the envelope 1. The envelope axis D between the first and second ends is substantially parallel with winding axes A, B and C.

Figure 3:
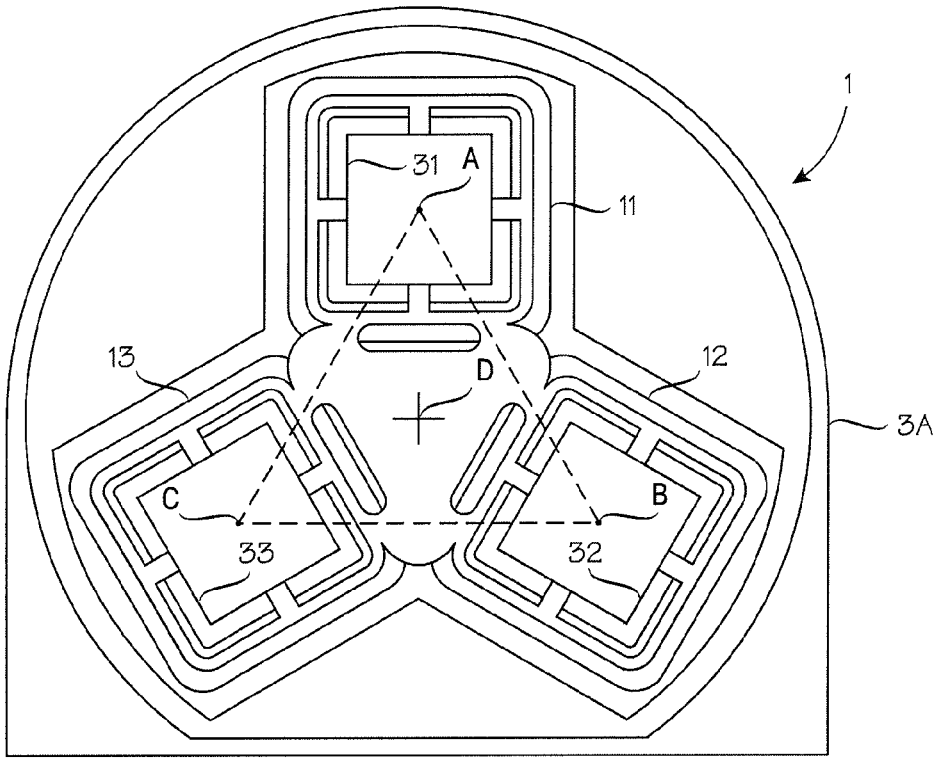
FIG. 3 shows the choke device for a frequency converter in accordance with an embodiment.

FIG. 3 shows the choke device of a frequency converter according to the embodiment for FIG. 1 viewed from the end 3A thereof in the direction of axes A, B C and D. Windings 11, 12 and 13 are located triangularly with respect to each other in such a manner that, when the choke device is viewed in the longitudinal direction of winding axes A, B and C in the manner shown in FIG. 3, winding axes A, B and C are located at the vertices of the triangle, i.e. in other words, lines drawn between the projection points of axes A, B and C constitute a triangle, as is demonstrated by dashed lines in FIG. 3. In the embodiment shown in FIG. 3, the triangle is a substantially equilateral triangle, but the triangle at whose vertices axes A, B and C of windings 11, 12 and 13 are located may also be a isosceles triangle or an irregular triangle.

Figure 4:
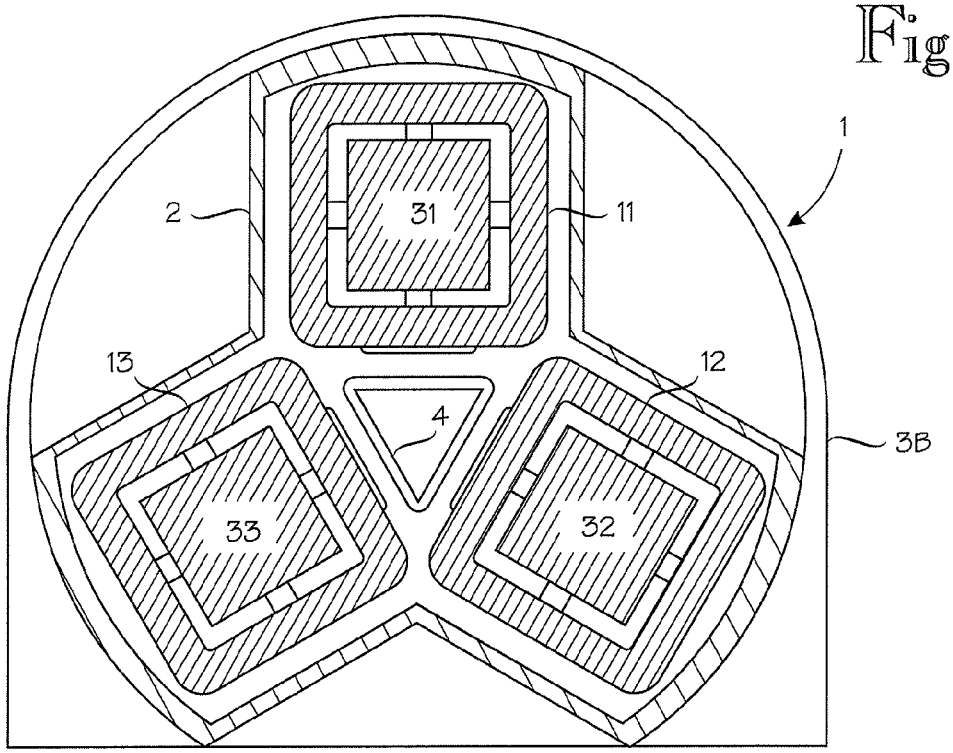
FIG. 4 shows a cross-section of the choke device for a frequency converter in accordance with an embodiment.

In accordance with an embodiment, the envelope 1 of the choke device of the frequency converter comprises a mid portion 2, which conforms to winding surfaces oriented outward from the triangle array of windings 11, 12 and 13 in such a manner that a gap remains between the mid portion of the envelope and the outwardly oriented surfaces of the windings, the gap enabling a flow of cooling medium between the mid portion of the envelope and the surfaces of the windings. FIG. 4 shows a cross-section of the mid portion 2 of the choke device of FIG. 1. The figure shows how a gap remains between the inner surface of the mid portion 2 of the envelope 1 and the surfaces of windings 11, 12 and 13 that are oriented outward from the triangle array, i.e. in the case of substantially quadrilateral windings, the surface of the three sides of each winding whose sides are oriented outwards from the triangle array composed by the windings, the mid portion 2 of the envelope conforming to the star-shaped external profile of the cross-section of windings 11, 12 and 13. It is to be noted that although in the example of FIG. 4, windings 11, 12 and 13 are not in contact with the inner surface of the mid portion 2 of the envelope, it is also possible, for example, that the angles between the outwards oriented sides of the windings are in contact with the inner surface of the mid portion 2 for supporting the structure. It is also possible to use some kind of support pieces between windings 11, 12 and 13 and the mid portion 2 of the envelope such that a sufficient circulation of cooling medium is enabled. The magnitude of the gap remaining between the inner surface of the mid portion 2 of the envelope 1 and the surfaces of windings 11, 12 and 13 that are oriented outward from the triangle array is case-specific and depends on the system to which the invention is applied, but, generally speaking, the gap is preferably made as narrow as possible in order for the flow of cooling medium to take place as close as possible to the windings to be cooled. On the other hand, a too narrow gap may cause a too high resistance to the circulation of cooling medium, so that the effect of the available cooling medium circulation, for example, has to be taken into account in the dimensioning. It is preferable to make the entire gap as equal in size as possible in order for the cooling of the windings to be even.

Figure 2:
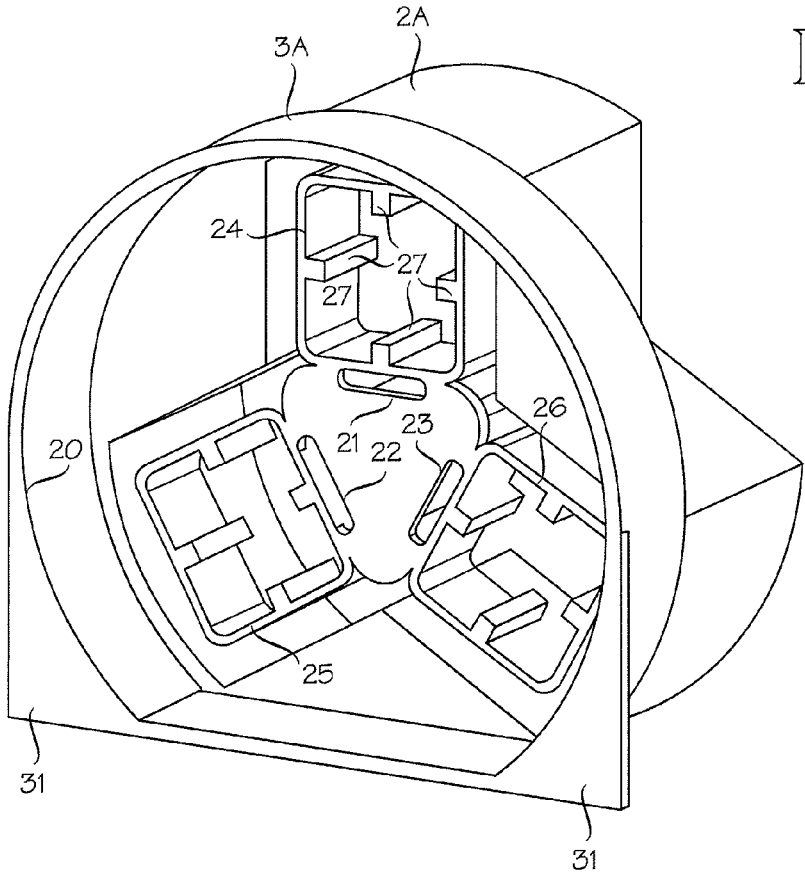
FIG. 2 shows the end portion of a choke device for a frequency converter in accordance with an embodiment.

Furthermore, in accordance with an embodiment, the envelope 1 of the choke device of the frequency converter comprises a first end portion 3A, which is provided with a plurality of openings 21, 22, 23, 24, 25 and 26 for guiding the cooling medium to be received at the envelope 1 further through windings 11, 12 and 13, and a second end portion 3B, which is also provided with a plurality of openings for guiding the cooling medium that has flown through the windings. FIG. 2 illustrates the end portion 3A and the openings 21, 22, 23, 24, 25 and 26 therein. Openings 21, 22 and 23 guide cooling medium to the middle of the inwards oriented sides of windings 11, 12 and 13, and openings 24, 25 and 26 around the windings and/or inside the windings, depending on the structure of the windings. It is to be noted that the shape, number and size of openings may vary significantly from what is shown in the figure without deviating from the basic idea of the invention. End portion 3B preferably comprises openings corresponding to those in end portion 3A shown in the figures. End portions 3A and 3B shown in the embodiments of FIGS. 1 and 2 further comprise a partly cylindrical collar, by means of which the choke device can be more easily connected to a cooling medium flow channel or the like, for example. In this case, the cooling medium is received in the choke device through an opening 20 in the collar of end portion 3A and further distributed to the windings through openings 21 to 26. Similarly, cooling medium discharged from the windings passes through the collar portion of end portion 3B. It is also feasible that end portions 3A and 3B do not comprise such a collar portion at all; instead, cooling medium is received in the choke device directly through openings 21 to 26 of end portion 3A and discharged therefrom through corresponding openings in end portion 3B. At least one edge of end portions 3A and 3B is preferably shaped even, whereby the choke device is easier to fasten onto an even surface. Support parts 31, which may serve as feet, may also be associated with end portions 3A and 3B. Furthermore, the choke device may comprise other support and fastening parts facilitating the fastening. Such may include fastening lugs (not shown in the figures) enabling a screw or clamping fastening.

In the embodiment shown in FIG. 4, the envelope 1 preferably comprises an inner portion 4, which conforms to the surfaces of the windings oriented inwards in the triangle array of windings 11, 12 and 13, i.e. in the case of quadrilateral windings, substantially to the surface of that side of each winging which is oriented towards mid axis D of the envelope in such a manner that a gap remains between the inner portion 4 of the envelope and the surfaces of the windings oriented inward, the gap enabling a flow of cooling medium between the inner portion of the envelope and the windings. The inner portion 4 may serve to control the flow of cooling medium in a controlled manner closer to the inwardly oriented surfaces of windings 11, 12 and 13 to be cooled. The inner portion 4 may be a closed structure or a hollow structure, as the one shown in the figures, which is closed at its ends by means of center parts remaining between openings 21, 22 and 23 of end portions 3A and 3B.

In accordance with an embodiment, the envelope 1 may be composed of two interconnected parts, one of which comprises the first end portion 3A and part 2A of the mid portion 2, the other comprising the second end portion 3B and part 2B of the mid portion 2. The parts may be similar to those shown in FIG. 2 and identical, which enables profitable production of the parts. It is also feasible that one part comprises a larger portion of the mid portion 2 than the other part, or the entire mid portion 2.

In accordance with an embodiment, each winding comprises a core comprising at least one pole 31, 32 and 33, around which the conductor or conductors 11, 12 and 13 of the winding are wound. Poles 31, 32 and 33 are preferably of magnetic material. Furthermore, the ends of the winding poles may be interconnected at both ends 3A and 3B of the choke device with yokes (not shown in the figures) of magnetic material, whereby a uniform core structure is achieved for all three windings. It is also feasible that windings 11, 12 and 13 are provided with air cores depending on the electrical properties required of the choke device. If windings 11, 12 and 13 are provided with air cores, suitable support structures, which are made from a non-magnetic material, may be used inside the windings.

Furthermore, in accordance with an embodiment, the first and second end portions 3A and 3B of the choke device of a frequency converter comprise slots 24, 25 and 26 for receiving the ends of poles 31, 32 and 33 and for fastening them in position with respect to each other. As slots 24, 25 and 26 are slightly larger than the ends of poles 31, 32 and 33, openings remain between the outer surfaces of the poles and the inner surfaces of the slots, through which openings cooling medium is able to flow into the immediate surroundings of windings 11, 12 and 13. In the embodiments shown in the figures, the inner surfaces of slots 24, 25 and 26 comprise support nodules 27, which come into contact with the ends of poles 31, 32 and 33, but do not prevent the cooling medium from flowing through slots 24, 25 and 26. Adjustment of the thickness of the support nodules 27 enables also the adjustment of the size of the openings remaining between the outer surfaces of the poles and the inner surfaces of the slots and thus the control of the cooling medium flow through the windings of the choke device structure. For this purpose, the nodules 27 may be of different thicknesses on the different surfaces of slot 24, 25 or 26, although they are shown to be of equal size in the figures. Such a structure may be used to accomplish both a controlled circulation of cooling medium and a steady structure. Alternatively, poles 31, 32 and 33 could be placed rotated about 45 degree cycle with respect to slots 24, 25 and 26, and instead of nodules, the inner surfaces of the slots could be provided with grooves into which the corners of the ends of the poles glide and fasten. Furthermore, poles 31, 32 and 33 may be round, for example, slots 24, 25 and 26 in that case being triangular, for example, whereby support nodules or grooves are not necessarily required. It is clear that many other structural alternatives may be applied in this connection without, however, deviating from the basic idea of the invention.

In the above-described embodiments of the choke device of a frequency converter, the envelope 1 used may be entirely or at least partly manufactured from a non-metallic material, such as plastic or a light metal material, such as aluminum. A combination of non-metallic and light metallic materials, for example, is also feasible. The material or materials to be used are preferably selected according to the requirements set by the application of the choke device.

The cooling medium used for cooling the choke device and conveyed through the windings in the embodiments described may be air or another gaseous substance, for example. Furthermore, the cooling medium may be a liquid substance, such as water. If air is used for cooling the frequency converter to which the choke device is applied, and if the frequency converter comprises a special airflow channel, through which cooling air is conveyed, it is preferable to place or otherwise connect the choke device into such an airflow channel. For this purpose, the choke device preferably comprises means for placing or connecting the choke device into the airflow channel of the frequency converter in such a manner that the air flowing in the airflow channel is conducted at least partly to the inside from one or more openings in the choke device for receiving the cooling medium. It is also feasible that the choke device comprises one or more fans for blowing air or another cooling medium to the inside of the choke device from said one or more openings for receiving the cooling medium. Such a fan may be fastened to the opening 20 of end portion 3A, for example.

The envelope structure of the choke device according to the above-described embodiments also allows the conductors originating from windings 11, 12 and 13 to be supported and isolated to the envelope 1 through suitably arranged through holes (not shown in the figures). Furthermore, an envelope structure of the described type enables a higher protection class of the windings and an easier transport and portability of the choke device, since the envelope protects the windings from stresses caused in a lifting situation of the choke device, for example.

It is obvious to a person skilled in the art that as technology advances, the basic idea of the invention can be implemented in a variety of ways. Consequently, the invention and its embodiments are not restricted to the above examples, but can vary within the scope of the claims.

The invention claimed is:

1. A choke device for a frequency converter, comprising:

three windings composed of conductors wound around three substantially parallel axes, respectively, which windings are located triangularly with respect to each other in such a manner that, when the choke device is viewed in the longitudinal direction of said winding axes, the winding axes are located at the vertices of the triangle; and an envelope surrounding the windings, a first end thereof being provided with at least one opening for receiving cooling medium to the inside of the envelope, and a second end being provided with at least one opening for discharging the cooling medium from the envelope, and the envelope comprising a mid portion conforming to winding surfaces oriented outwards from the triangular array of the windings in such a manner that a gap remains between the mid portion of the envelope and the outwardly oriented surfaces of the windings, the gap enabling the flow of said cooling medium between the mid portion of the envelope and the windings through the windings, and an envelope axis between said first and second ends being substantially parallel with the winding axes.

2. The choke device for a frequency converter of claim 1, wherein said triangle, at the vertices of which the winding axes are located, is a substantially equilateral triangle, an isosceles triangle or an irregular triangle.

3. The choke device for a frequency converter of claim 1, wherein the envelope comprises:

a first end portion provided with a plurality of openings for guiding the cooling medium to be received into the envelope further through the windings; and a second end portion provided with a plurality of openings for guiding the cooling medium flown through the windings.

4. The choke device for a frequency converter of claim 3, wherein the envelope further comprises an inner portion, which conforms to winding surfaces oriented inwards in the triangular array of the windings in such a manner that a gap remains between the inner portion of the envelope and the inwardly oriented surfaces of the windings, the gap enabling the flow of cooling medium between the inner portion of the envelope and the windings.

5. The choke device for a frequency converter of claim 3, wherein the envelope is composed of a first part comprising the first end portion and part of the mid portion, and a second part comprising the second end portion and part of the mid portion, the first and second parts being interconnected.

6. The choke device for a frequency converter of claim 1, wherein each winding comprises a core comprising at least one pole around which a conductor or conductors of the winding is wound.

7. The choke device for a frequency converter of claim 3, wherein the first and second end portions comprise slots for receiving and fastening the ends of the poles.

8. The choke device for a frequency converter of claim 6, wherein said poles are of a magnetic material.

9. The choke device for a frequency converter of claim 8, wherein the ends of the winding poles are interconnected at each end of the choke device with yokes of a magnetic material.

10. The choke device for a frequency converter of claim 1, wherein the envelope is at least partly of a non-metallic or a light metallic material.

11. The choke device for a frequency converter of claim 1, wherein the cooling medium is air.

12. The choke device for a frequency converter of claim 11, wherein the choke device comprises means for placing or connecting the choke device into an airflow channel of the frequency converter in such a manner that the air flowing in the airflow channel is at least partly conducted to the inside from said one or more openings for receiving the cooling medium.

13. The choke device for a frequency converter of claim 11, wherein the choke device comprises one or more fans for blowing air to the inside of the choke device from said one or more openings for receiving the cooling medium.

14. The choke device for a frequency converter of claim 1, wherein the choke device comprises a three-phase choke.

15. The choke device for a frequency converter of claim 1, wherein the choke device comprises three single-phase chokes.

16. The choke device for a frequency converter of claim 1, wherein the choke device is an input choke of a frequency converter.

17. The choke device for a frequency converter of claim 1, wherein the choke device is an output choke of a frequency converter.

* * * * *